US008747157B2

(12) United States Patent
Tashiro

(10) Patent No.: US 8,747,157 B2
(45) Date of Patent: Jun. 10, 2014

(54) CONNECTOR

(75) Inventor: Harunori Tashiro, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/702,416

(22) PCT Filed: Oct. 12, 2011

(86) PCT No.: PCT/JP2011/073368

§ 371 (c)(1),
(2), (4) Date: Dec. 6, 2012

(87) PCT Pub. No.: WO2012/066869

PCT Pub. Date: May 24, 2012

(65) Prior Publication Data

US 2013/0078872 A1 Mar. 28, 2013

(30) Foreign Application Priority Data

Nov. 15, 2010 (JP) ..... 2010-254751

(51) Int. Cl.

| | |
|---|---|
| ***H01R 13/40*** | (2006.01) |
| ***H01R 13/422*** | (2006.01) |
| ***H01R 13/436*** | (2006.01) |
| ***H01R 13/506*** | (2006.01) |
| ***H01R 13/52*** | (2006.01) |
| *H01R 103/00* | (2006.01) |

(52) U.S. Cl.

CPC ..... *H01R 13/4223* (2013.01); *H01R 13/4362* (2013.01); *H01R 13/506* (2013.01); *H01R 13/5221* (2013.01); *H01R 2103/00* (2013.01)

USPC ..... 439/595; 439/246

(58) Field of Classification Search

USPC ..... 439/695, 595, 701, 871

See application file for complete search history.

(56) References Cited

U.S. PATENT DOCUMENTS

| | | | | |
|---|---|---|---|---|
| 5,037,336 | A | 8/1991 | Betsui | |
| 5,350,320 | A * | 9/1994 | Hashizawa et al. | 439/752 |
| 5,356,317 | A * | 10/1994 | Shinji | 439/752 |
| 5,520,553 | A | 5/1996 | Cecil, Jr. et al. | |

(Continued)

FOREIGN PATENT DOCUMENTS

| | | |
|---|---|---|
| EP | 0 716 473 | 6/1996 |
| EP | 1 548 892 | 6/2005 |

(Continued)

OTHER PUBLICATIONS

Communication and Supplementary European Search Report issued by the European Patent Office on Mar. 5, 2014 in corresponding Application No. EP 11841082.8 (7 pages).

*Primary Examiner* — Neil Abrams
*Assistant Examiner* — Travis Chambers
(74) *Attorney, Agent, or Firm* — Finnegan, Henderson, Farabow, Garrett & Dunner, L.L.P.

(57) ABSTRACT

A connector includes: a terminal (2) having a terminal locking hole (3); a housing (10) including a terminal cavity (11) into which the terminal (2) is inserted, and a housing lance (12) configured to be locked with the terminal locking hole (3) of the terminal (2) inserted into the terminal cavity (11); and a holder (20) configured to be fitted to the housing (10) and having a holder elastic arm (23) for biasing the terminal (2) in a direction of hooking the terminal (2) to the housing lance (12).

2 Claims, 11 Drawing Sheets

(56) References Cited

U.S. PATENT DOCUMENTS

| | | | | |
|---|---|---|---|---|
| 5,951,332 | A * | 9/1999 | Wang | 439/686 |
| 8,342,880 | B2 * | 1/2013 | Kato et al. | 439/595 |
| 8,475,207 | B2 * | 7/2013 | Obata et al. | 439/595 |
| 2011/0014822 | A1 | 1/2011 | Kato et al. | |

FOREIGN PATENT DOCUMENTS

| | | |
|---|---|---|
| JP | 8-241749 | 9/1996 |
| JP | 2003-100377 | 4/2003 |
| JP | 2006-185872 | 7/2006 |
| WO | WO 2009/110639 A2 | 9/2009 |

* cited by examiner

CONNECTOR

TECHNICAL FIELD

The present invention relates to a connector installed to an automotive wire harness or the like.

BACKGROUND ART

As a connector of this type according to a conventional example, one that is illustrated in FIGS. 1 and 2 is given. In FIGS. 1 and 2, a connector 100A includes a plurality of terminals 101, a housing 110 for holding each of the terminals 101, and a shell 120 fitted to an outer periphery of the housing 110.

Each of the terminals 101 is fixed to an end portion of each electric wire W. Each of the terminals 101 has a terminal locking hole 102. Each of the terminals 101 is so disposed as to be inserted into each terminal cavity 111 of the housing 110. The housing 110 has a plurality of housing lances 112. Each of the housing lance 112 is locked with the terminal locking hole 102 of each of the terminals 101. Each of the terminal 101 is held to the housing 110 by a locking force of the housing lance 112.

Further, as a connector according to another conventional example, one that is illustrated in FIGS. 3 and 4 is given (refer to PTL 1). In FIGS. 3 and 4, a connector 100B includes a plurality of terminals 101, a housing 110 for holding each of the terminals 101, and a shell 120 fitted to an outer periphery of the housing 110.

Each of the terminals 101 is fixed to an end portion of each electric wire W. Each of the terminals 101 has a terminal locking hole 102. Each of the terminals 101 is so disposed as to be inserted into each terminal cavity 111 of the housing 110. The housing 110 has a plurality of housing lances 112. Each of the housing lances 112 is locked with the terminal locking hole 102 of each of the terminals 101. Each of the terminals 101 is held to the housing 110 by a locking force of the housing lance 112. The housing 110 has a plurality of pairs of upper and lower housing elastic arms 113. Each pair of the housing elastic arms 113 bias each of the terminals 101. In the terminal cavity 111, each of the terminals 101 is held in a position where the elastic forces of the pair of the upper and lower housing elastic arms 113 are balanced. Against the elastic forces of the pair of the upper and lower housing elastic arms 113, each of the terminals 101 can move upward and downward in the terminal cavity 111.

CITATION LIST

Patent Literature

PTL 1: WO 2009/110639 A2

SUMMARY OF INVENTION

Incidentally, with the connector 100A according to the conventional example illustrated in FIGS. 1 and 2, the dimension of the terminal cavity 111 of the housing 110 is set slightly larger than the thickness of the terminal 101 in view of component part dimensional errors, insertion property of the terminal 101, and the like. Thus, the terminal 101 can move in a direction away from the housing lance 112. When the terminal 101 moves in the direction away from the housing lance 112, the terminal 101 may be locked at a distal end portion of the housing lance 112, that is, a portion having a small shear area. In this case, the locking force of the housing lance 112 becomes weak, thus causing a problem that a desired terminal holding force that is continuously stable cannot be obtained.

Especially, with a high-current and high-voltage connector for automobile, an electric wire connected to the above connector has a thick diameter, and therefore, the electric wire itself has a very high rigidity. Therefore, bending of a wire harness causes a line length difference between the bending inner side and the bending outer side, thus causing a large tensile load to be exerted between the terminal 101 and the housing 110. Thus, unless the connector 100A has the desired terminal holding force that is continuously stable, the tensile load may damage the housing lance 112 which may lead to disengagement of the terminal. Here, for preventing the damage of the housing lance 112, it is conceivable to propose such measures as to secure the shear area at the distal end side of the housing lance 112 or to improve the rigidity itself of the housing lance 112. These measures are, however, not practical and therefore not adoptable due to problems which may be caused associated with space, operability, cost, and the like.

Further, with the connector 100B according to the other conventional example illustrated in FIGS. 3 and 4, the pair of the housing elastic arms 113 are so disposed as to protrude into the terminal cavity 111 of the housing 110. Thus, at the time of inserting the terminal 101 into the terminal cavity 111, a problem may arise that a prying force and the like may damage the hosing elastic arms 113. Especially, with the connector 100B according to the other conventional example, the dimension of the terminal cavity 111 of the housing 110 is set larger than the thickness of the terminal 101, specifically, still larger compared with the conventional example. Therefore, at the time of inserting the terminal 101 into the terminal cavity 111 of the housing 110, the inserting direction of the terminal 101 is not stable, causing a higher possibility of damaging the housing elastic arms 113 by the prying force and the like.

The present invention has been made for solving the above problems. It is an object of the present invention to provide a connector capable of achieving a desired terminal holding force that is continuously stable and capable of eliminating a possibility of damaging elastic arms at the time of inserting the terminal.

A connector according to a first aspect of the present invention includes: a terminal having a terminal locking hole; a housing including a terminal cavity into which the terminal is inserted, and a housing lance configured to be locked with the terminal locking hole of the terminal inserted into the terminal cavity; and a holder configured to be fitted to the housing and having a holder elastic arm for biasing the terminal in a direction of hooking the terminal to the housing lance.

It is preferable that the holder includes an arm support portion for supporting the holder elastic arm, and a holder locking portion disposed at an opposite side of the arm support portion, and that the housing includes a housing locking arm, and the housing locking arm be configured to be locked with the holder locking portion.

The terminal may have a bolt tightening hole.

With the connector according to the first aspect of the present invention, since the holder elastic arm biases the terminal in the direction of hooking the terminal to the housing lance, the terminal is unlikely to be shifted in the direction away from the housing lance. Thus, the terminal can be locked in a root portion of the housing lance, that is, a portion having a large shear area. Therefore, the locking force of the housing lance can be prevented from being weak. Further, the terminal is inserted into the terminal cavity of the housing, and then, the holder is fitted to the housing. Thus, at the time of inserting the terminal into the terminal cavity, there is no possibility of damaging the holder elastic arm with the insertion of the terminal. To summarize the above, the connector capable of achieving, in the terminal cavity, a desired terminal holding force that is continuously stable can be obtained, without any possibility of damaging the holder elastic arm at the time of inserting the terminal.

DESCRIPTION OF EMBODIMENTS

Hereinafter, a description will be made below of one embodiment of the present invention based on the drawings.

Figure 1:
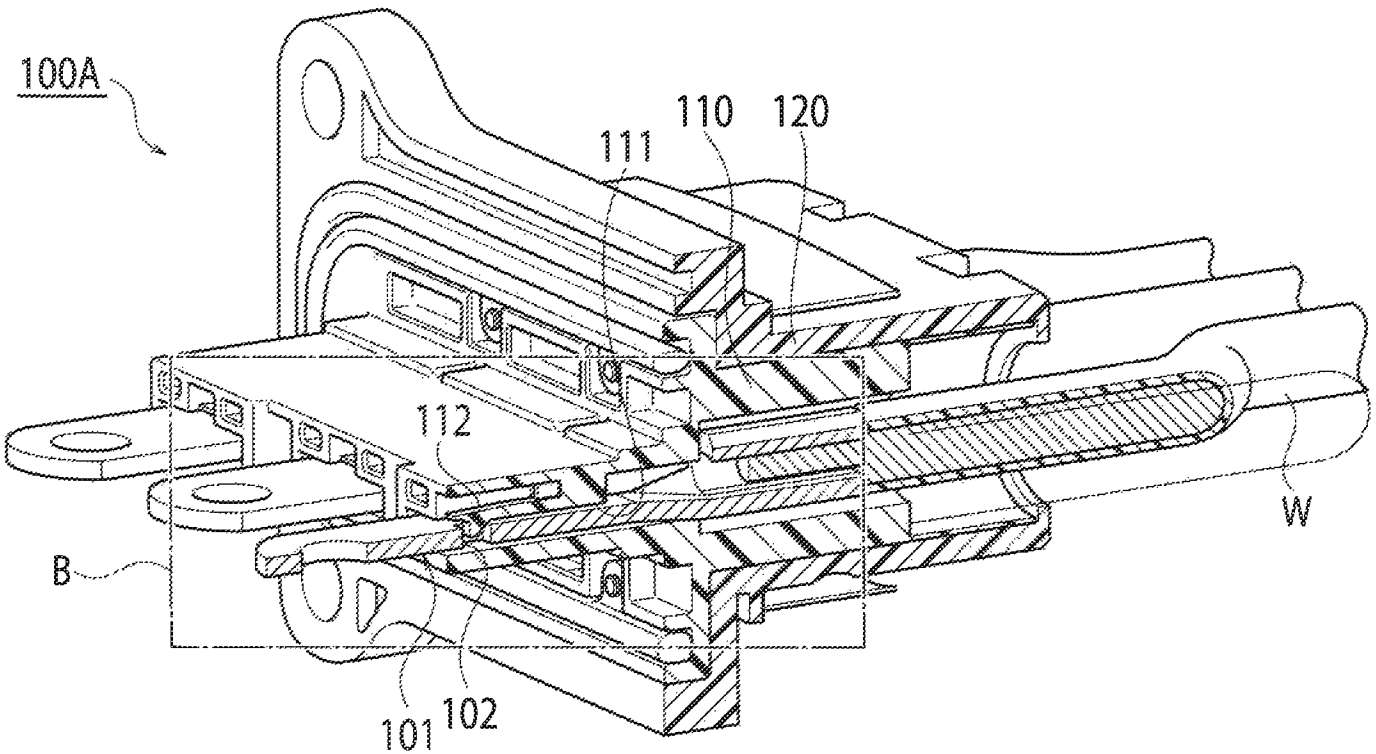
FIG. 1 is a partially broken perspective view of a connector according to a conventional example.
Figure 2:
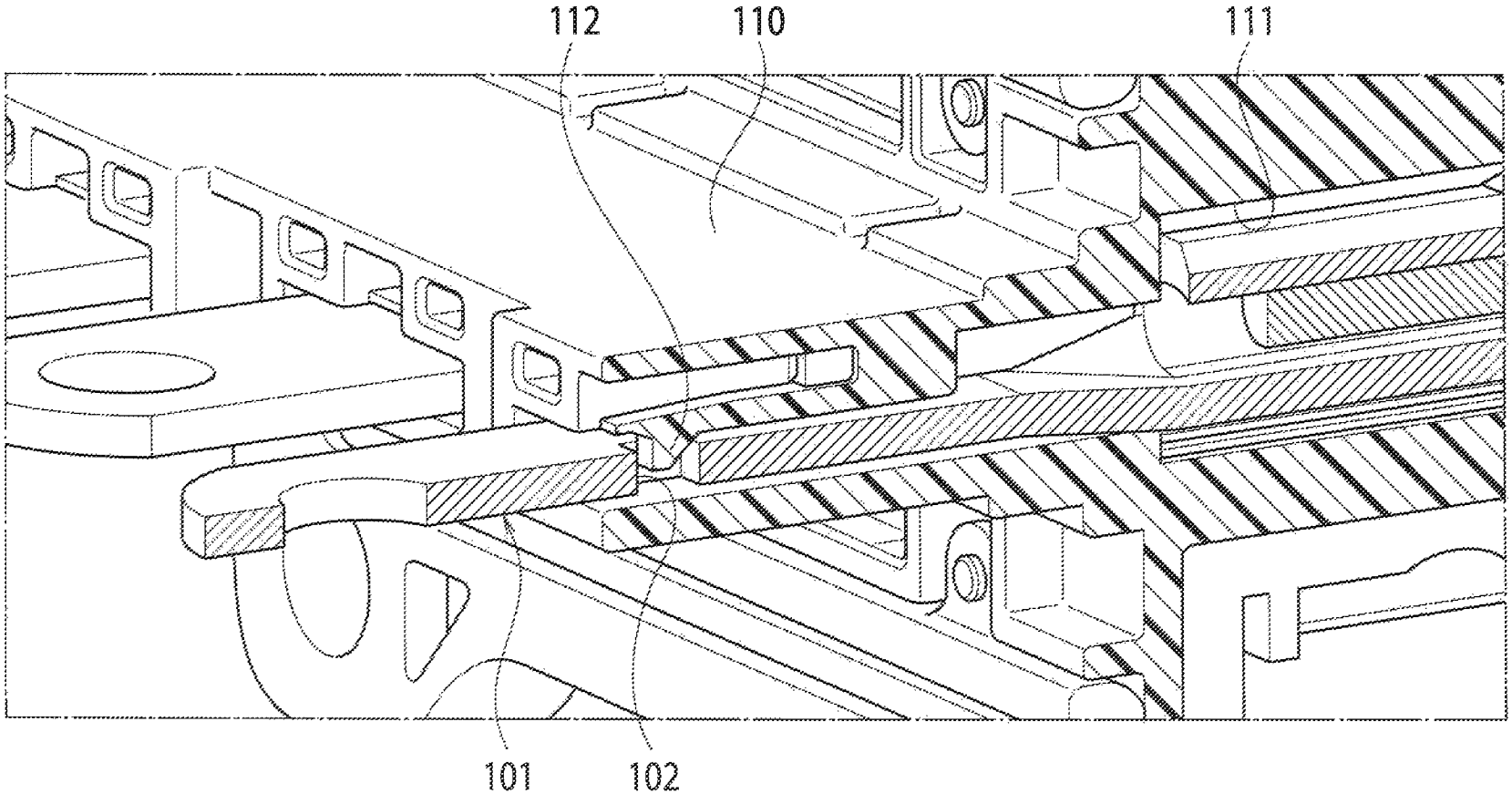
FIG. 2 is an enlarged view of part B of the connector illustrated in FIG. 1, according to the conventional example.
Figure 3:
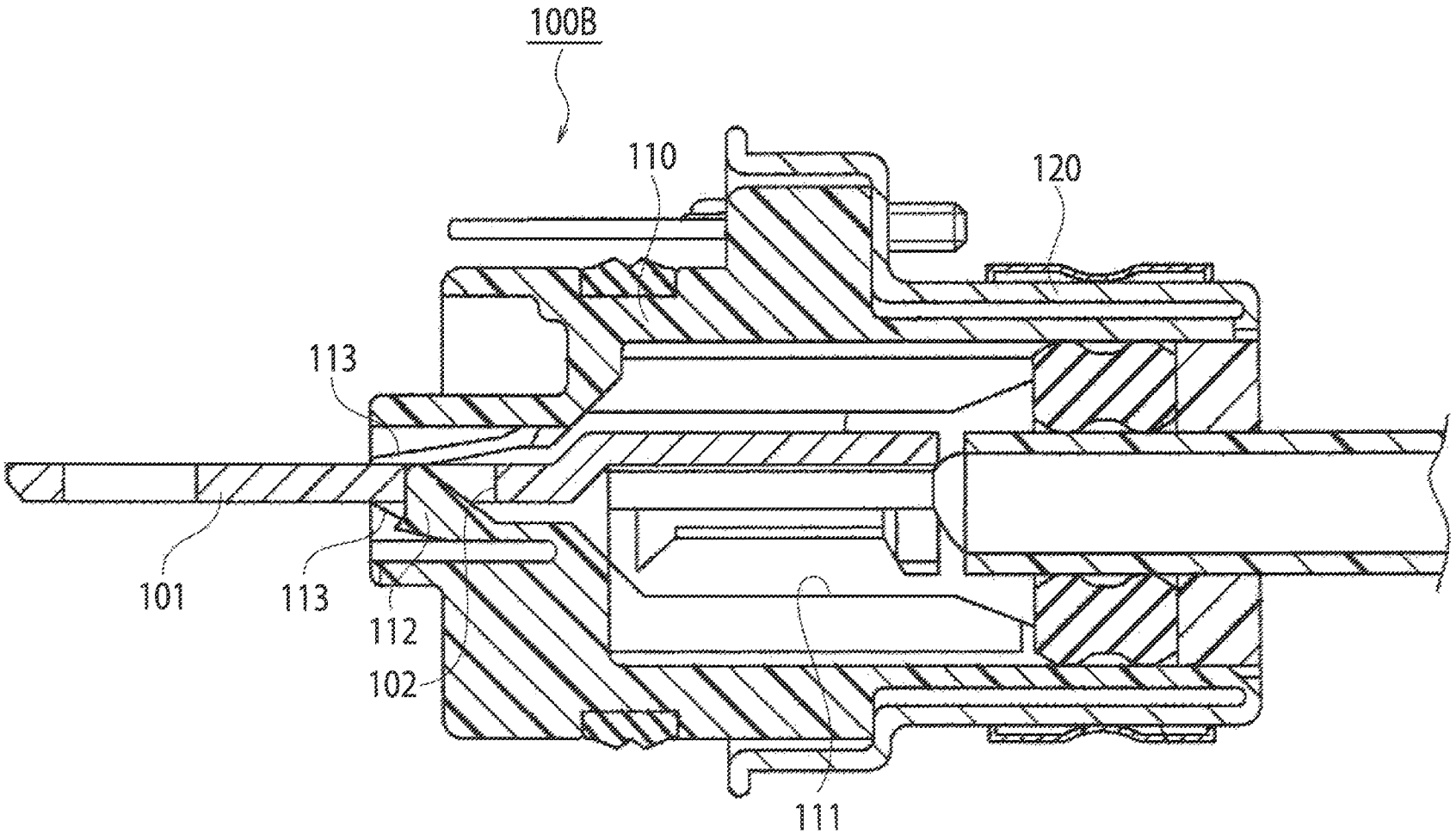
FIG. 3 is a cross sectional view illustrating that a connector is cut in a portion where a structure of locking a terminal and a housing lance is seen, according to another conventional example.
Figure 4:
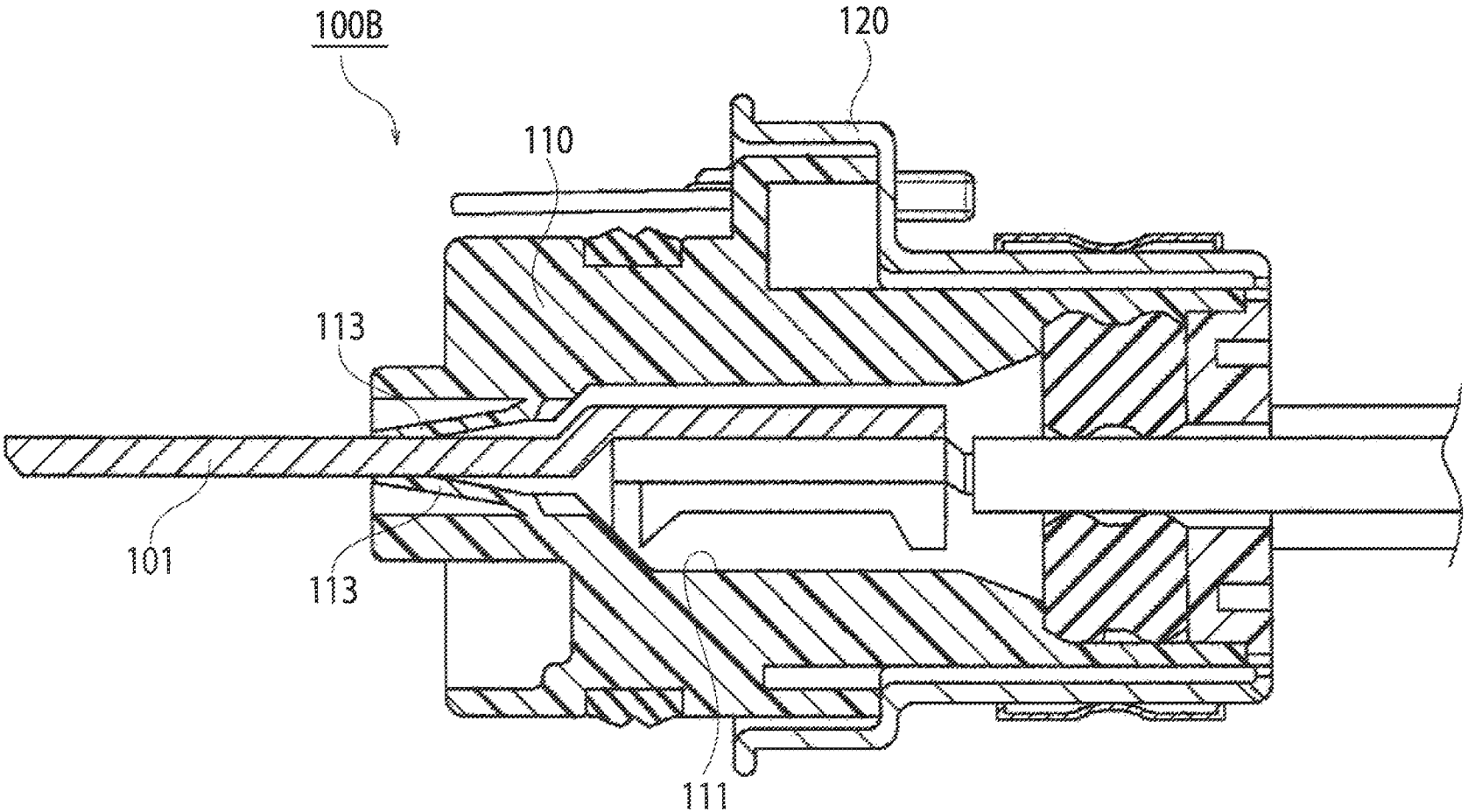
FIG. 4 is a cross sectional view illustrating that the connector illustrated in FIG. 3 is cut in a portion where a structure that housing elastic arms hold the terminal is seen, according to the other conventional example.
Figure 5:
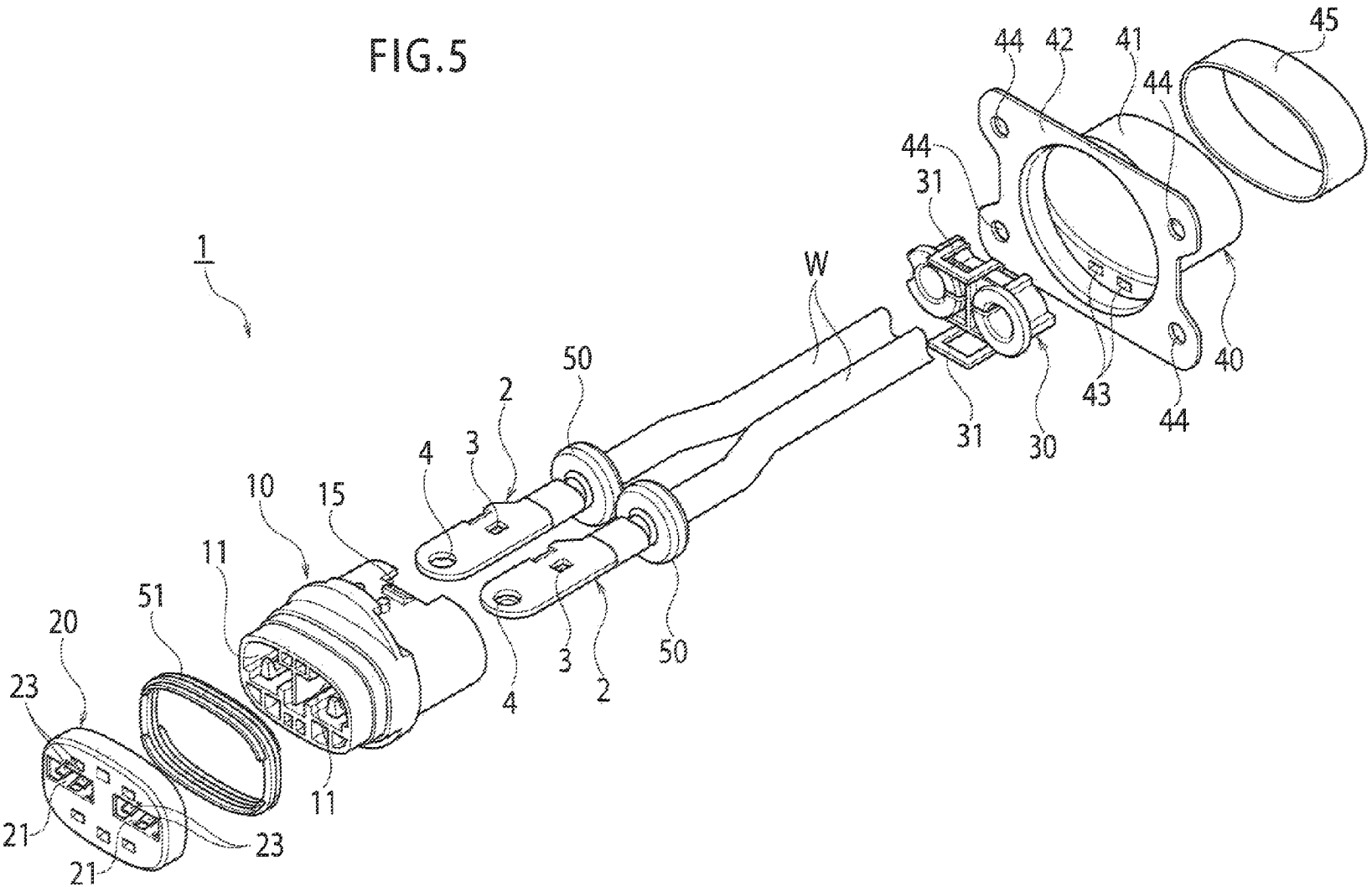
FIG. 5 is an exploded perspective view of a connector, according to one embodiment of the present invention.
Figure 6:
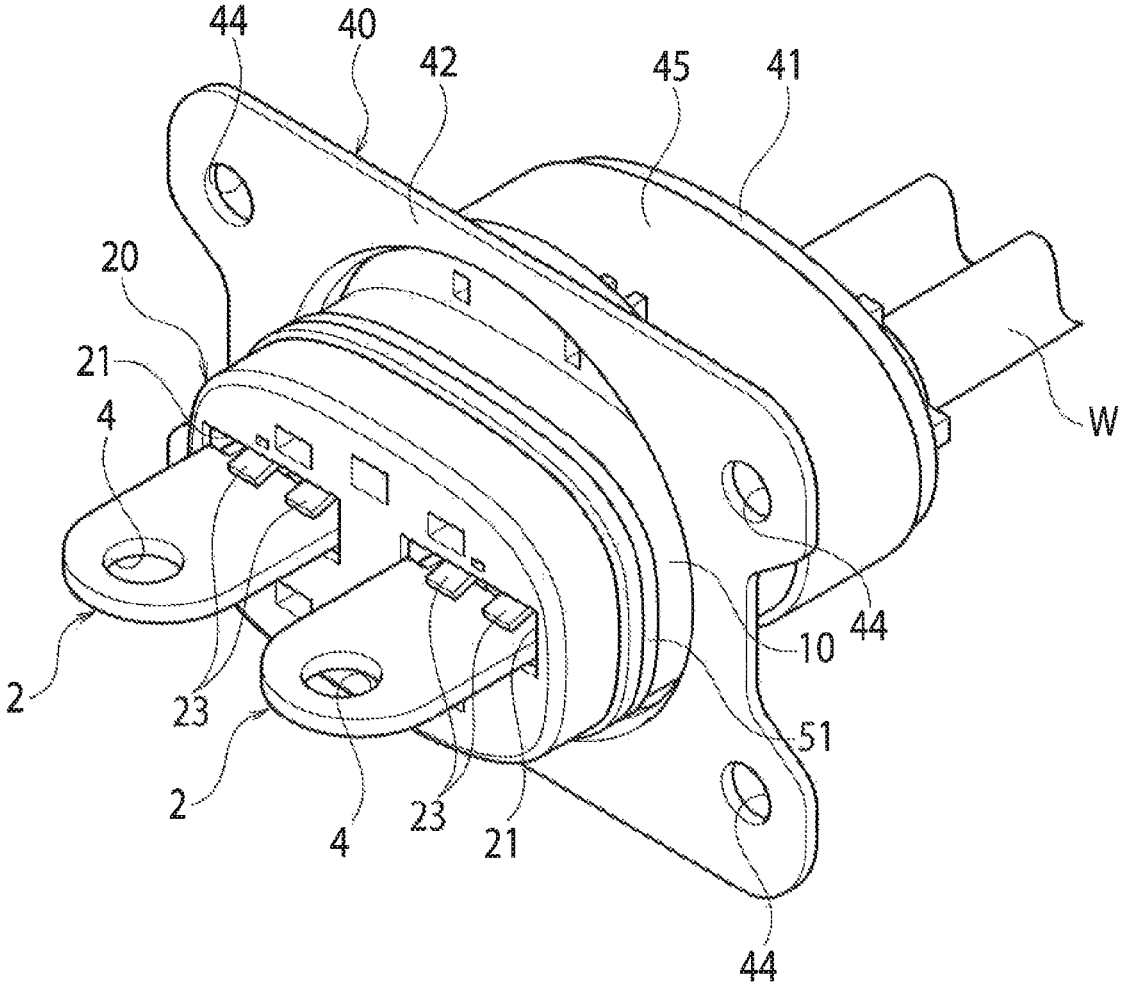
FIG. 6 is a perspective view of the connector seen from a front side, according to the embodiment of the present invention.
Figure 7:
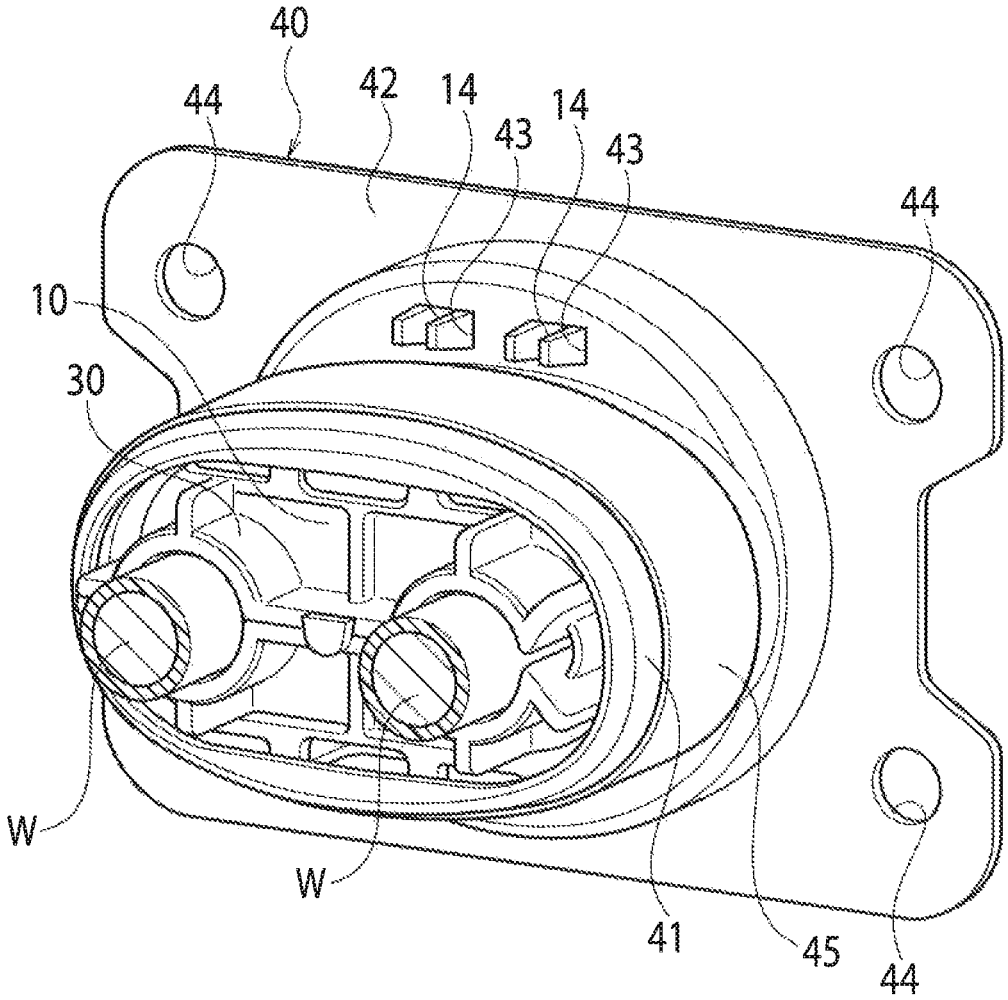
FIG. 7 is a perspective view of the connector seen from a rear side, according to the embodiment of the present invention.
Figure 8:
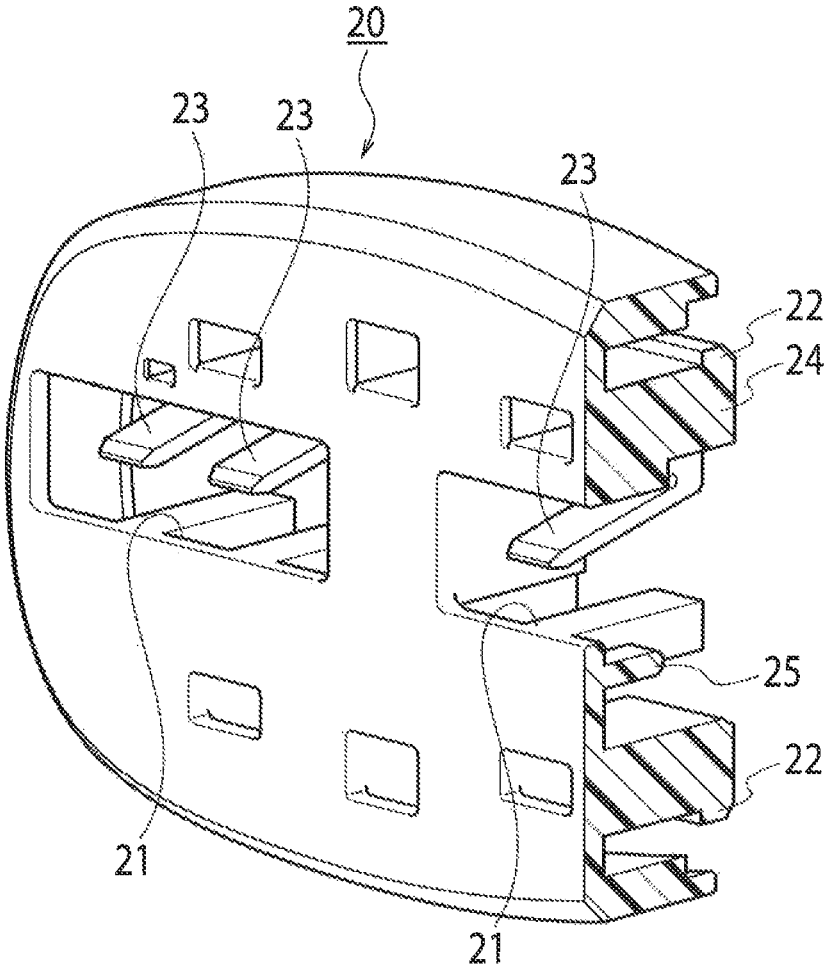
FIG. 8 is a perspective view of a front holder of the connector, according to the embodiment of the present invention.
Figure 9:
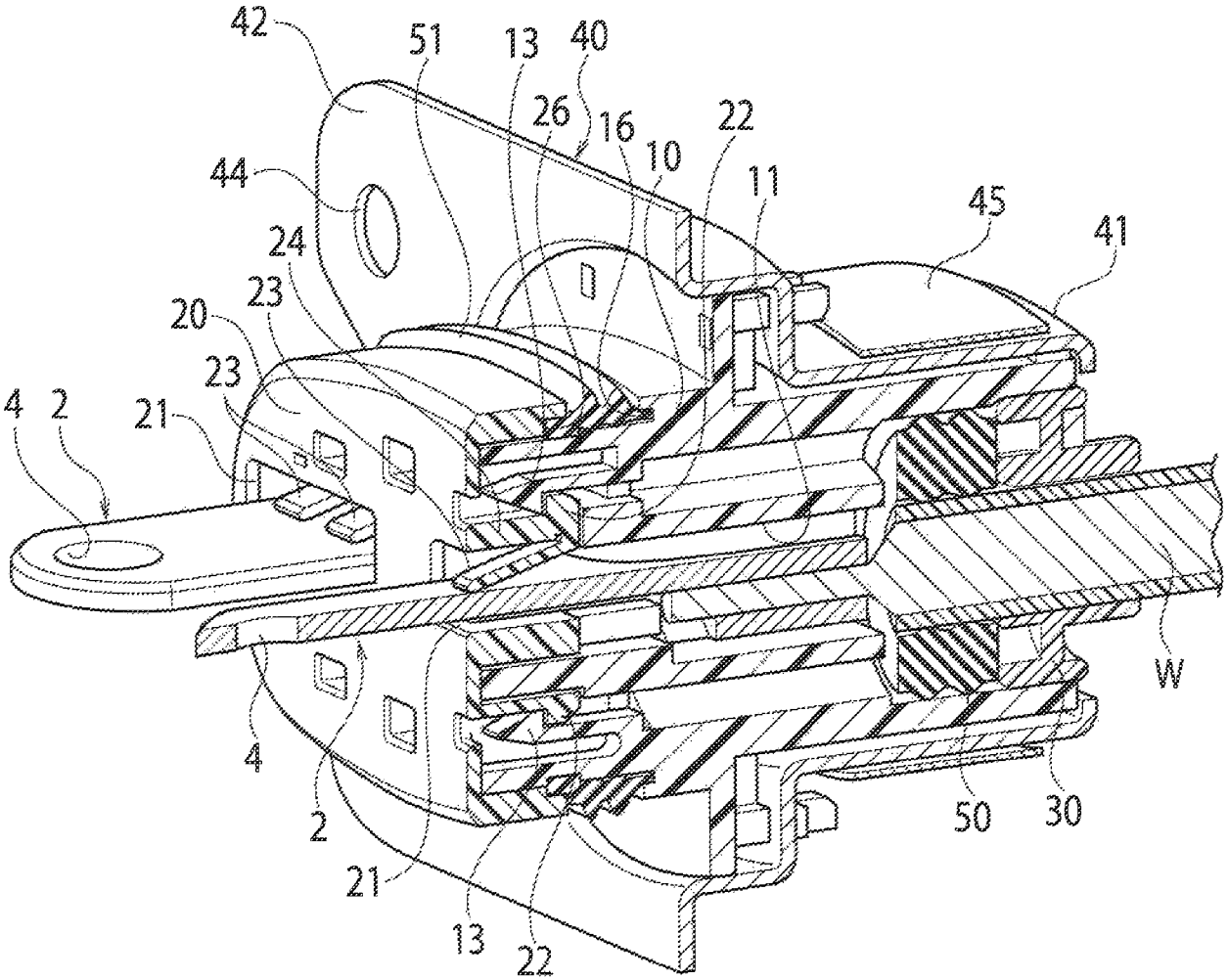
FIG. 9 is a cross sectional view illustrating that the connector is cut in a portion where a structure of locking a housing and the front holder is seen, according to the embodiment of the present invention.
Figure 10:
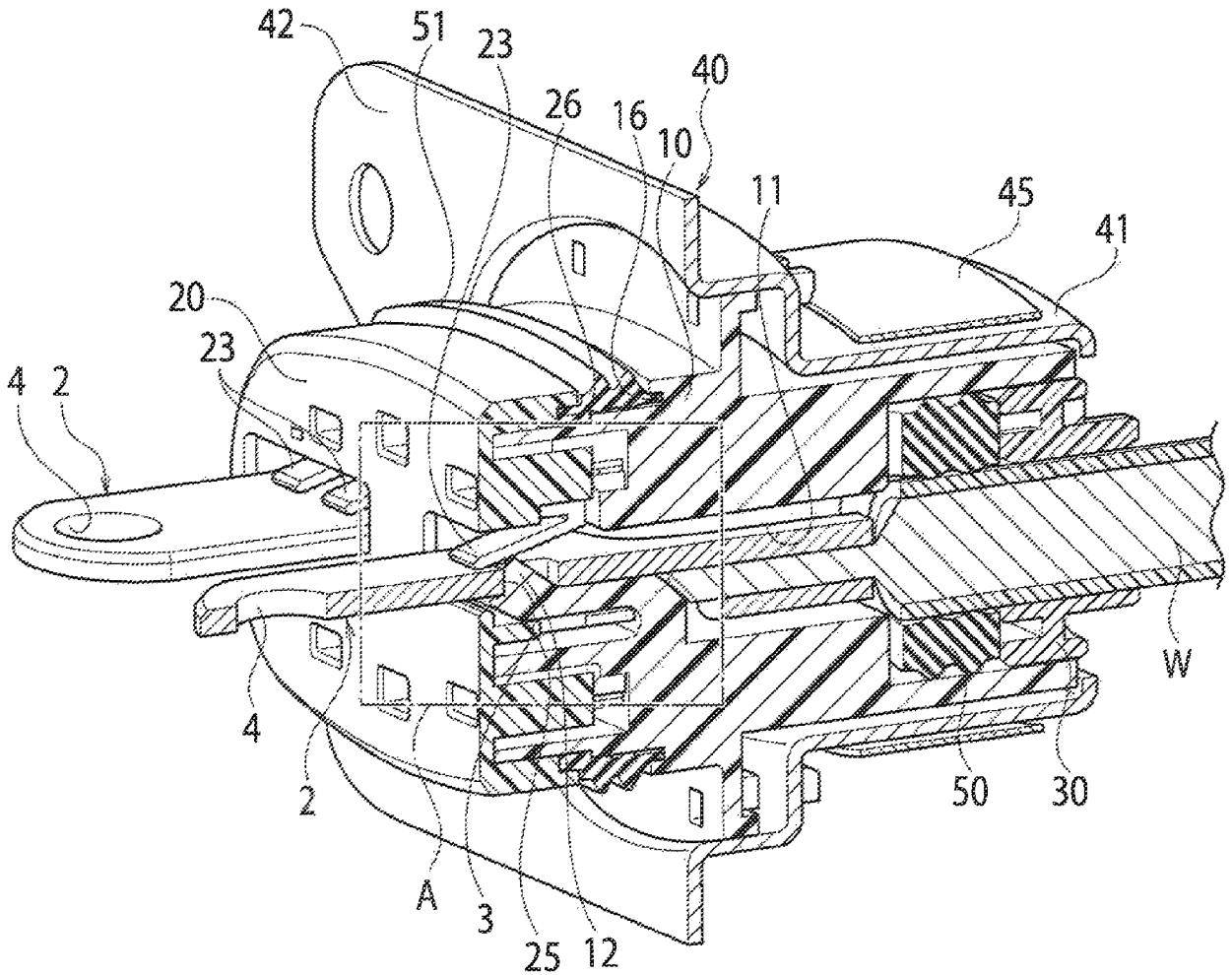
FIG. 10 is a cross sectional view illustrating that the connector is cut in a portion where a structure of locking the terminal and a housing lance is seen, according to the one embodiment of the present invention.
Figure 11:
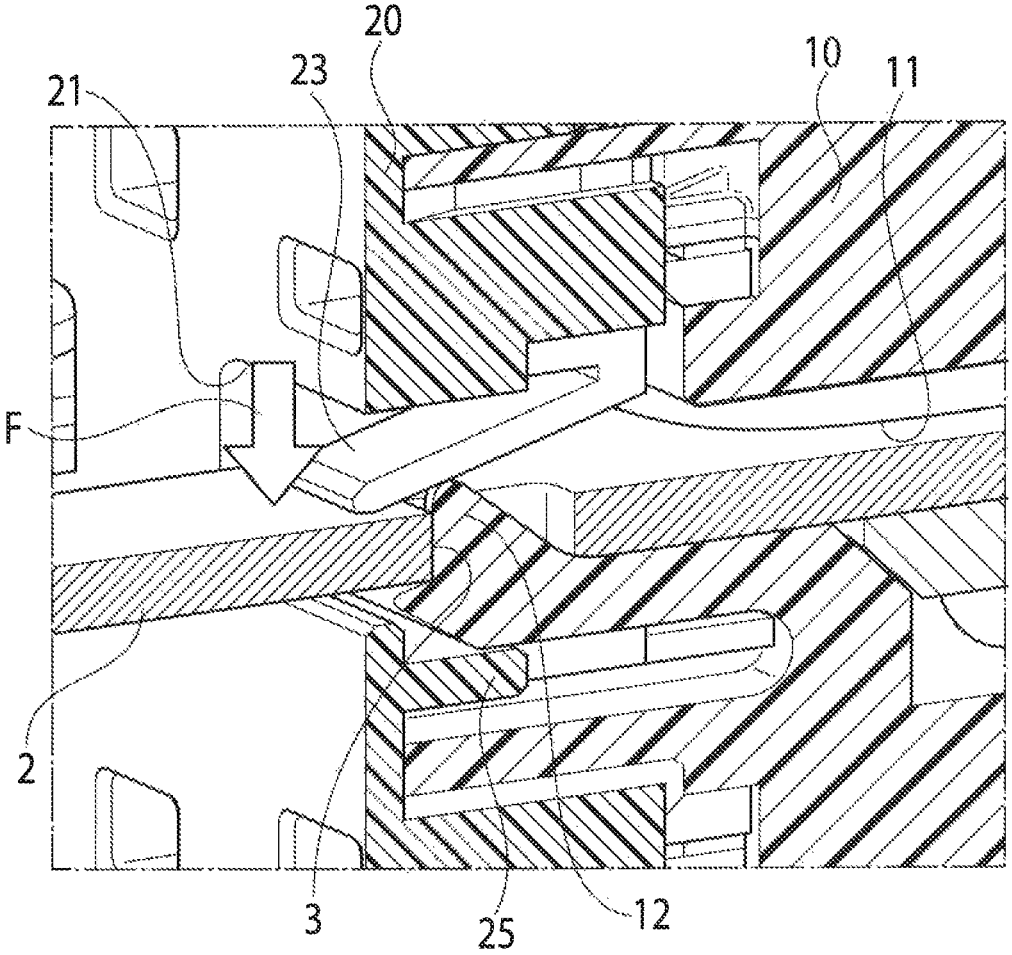
FIG. 11 is an enlarged view of part A of the connector illustrated in FIG. 10, according to the one embodiment of the present invention.

FIGS. 5 to 11 illustrate a connector 1 according to one embodiment of the present invention. In FIGS. 5 to 11, the connector 1 includes two terminals 2, a housing 10 for holding the two terminals 2, a front holder 20 as a holder fitted to a front side of the housing 10, a rear holder 30 fitted to a rear side of the housing 10, a shell 40 disposed on an outer periphery of the housing 10, and a shield ring 45 disposed on a further outer periphery of the shell 40.

Each of the terminals 2 is made of conductive metal. Each of the terminals 2 has a terminal locking hole 3 and a bolt tightening hole 4. The terminal locking hole 3 is formed in a portion positioned within the housing 10 and front holder 20. The bolt tightening hole 4 is formed in a portion protruding outwardly from the front holder 20. By utilizing the bolt tightening hole 4, a bolt tightens each of the terminals 2 to a terminal bench of a cabinet (not illustrated) as a mounting side. An end portion of each electric wire W is fixed to each of the terminals 2 by a crimping operation. A rubber plug 50 is put on each electric wire W.

The housing 10 is made of insulating synthetic resin. The housing 10 is provided with two terminal cavities 11 at an interval. Each of the terminals 2 is inserted to concerned terminal cavity 11 and thereby is disposed in the terminal cavity 11. In the housing 10, protruding housing lances 12 are provided in the terminal cavities 11. Each of the housing lances 12 is locked with the terminal locking hole 3 of each of the terminals Each of the terminals 2 is fixed to the housing 10 by a locking force of concerned housing lance 12 such that the terminals 2 cannot be pulled out from the terminal cavity 11. At a front side of the housing 10, housing locking arms 13 are provided. At a rear side of the housing 10, housing locking arms 14 and housing lock portions 15 are provided.

The front holder 20 is made of insulating synthetic resin. The front holder 20 is fitted to the front side of the housing 10 via a packing 51. The front holder 20 has two terminal through holes 21. Each of the terminals 2 protrudes from concerned terminal through hole 21 toward the front side. Holder locking portions 22 are provided at the front holder 20. The housing locking arms 13 are locked with the holder locking portions 22. Accordingly, the front holder 20 is locked to the housing 10. A pair of holder elastic arms 23 are disposed at two portions of the front holder 20. By an elastic force F (illustrated in FIG. 11), each of the holder elastic arms 23 is biased in a direction to hook the terminal 2 to concerned housing lance 12. The holder elastic arms 23 are supported by arm support portions 24. At an opposite side of the arm support portions 24, there are provided the holder locking portions 22.

In the front holder 20, protruding portions 25 are provided at positions spaced apart from the holder elastic arms 23 at respective positions. When the front holder 20 is caused to fit to the housing 10, in a state where each of the housing lances 12 is not locked with the terminal locking hole 3, each of the protruding portions 25 abuts the distal end portion of concerned housing lance 12. This prevents the front holder 20 from being fitted to the housing 10. On the other hand, when the front holder 20 is fit to the housing 10, in a state where each of the housing lances 12 is locked with concerned terminal locking hole 3, each of the protruding portions 25 does not abut the distal end portion of concerned housing lance 12. This allows the front holder 20 to be fitted to the housing 10. And in the position where the front holder 20 is fitted to the housing 10, each of the protruding portions 25 comes into a position where concerned housing lance 12 cannot be elastically deformed in a direction to drop off from concerned terminal locking hole 3. That is, in the process where the front holder 20 is being fitted to the housing 10, each of the protruding portion 25 has a mating detection function of concerned housing lance 12. On the other hand, after the front holder 20 has been fitted to the housing 10, each of the protruding portions 25 has a double-locking function of concerned housing lance 12.

The packing 51 is disposed in such a state that each part of the packing 51 is mated into a peripheral edge groove 16 of the housing 10 and a peripheral edge groove 26 of the front holder 20 respectively. The packing 51 stops water between the housing 10 and the cabinet (not illustrated) as the mounting side.

The rear holder 30 is fitted to the two terminal cavities 11 of the housing 10 together with the two rubber plugs 50. The rear holder 30 prevents each of the rubber plugs 50 from dropping off from concerned terminal cavity 11. Each of the rubber plugs 50 stops water between the electric wire W and the housing 10. The rear holder 30 has two separate members connected with each other via a hinge (not illustrated), and the separate members are caused to fit over outer peripheries of the electric wires W by utilizing the hinge. The rear holder 30 has a pair of upper and lower holder locking arms 31. Each of the holder locking arms 31 is locked to one of the housing locking portions 15. Accordingly, the rear holder 30 is locked to the housing 10.

The shell 40 is made of conductive metal. The shell 40 has a tubular portion 41 into which the housing 10 is inserted and a flange portion 42 protruding outwardly from the tubular portion 41. The tubular portion 41 is provided with shell locking holes 43. The housing locking arms 14 are locked to the shell locking holes 43. Accordingly, the shell 40 is locked to the housing 10. The flange portion 42 is provided with four tightening holes 44 near four corners. By utilizing the tightening holes 44, the connector 1 is fixed to the cabinet (not illustrated) on the mounting side with bolts (not illustrated).

The shield ring 45 is fixed on to the tubular portion 41 of the shell 40 via an end portion of a braided wire (not illustrated) by crimping. The braided wire covers the electric wires W. That is, the braided wire is connected to earth by the shell 40, by the bolt (not illustrated) fixed to the cabinet (not illustrated), and by the cabinet (not illustrated). Accordingly, the electromagnetic wave which may be caused when a high voltage current flows in the electric wires W is shielded.

Next, procedures for assembling the connector 1 will be briefly explained.

First, the rubber plug 50 is put on each of the electric wires W. The end portion of each of the electric wires W on which the rubber plug 50 has been put is fixed to the terminal 2 by crimping.

Then, each terminal 2 is inserted into the terminal cavity 11 from the rear side of the housing 10. When the distal end of the terminal 2 abuts the housing lance 12, the housing lance 12 is elastically deformed. This allows insertion of the terminal 2. When the terminal 2 is inserted to the insertion completion position, the housing lance 12 coincides with the position of the terminal locking hole 3 of the terminal 2. Then, an elastic recovery deformation of the housing lance 12 causes the housing lance 12 to be locked with the terminal locking hole 3 of the terminal 2. Accordingly, the terminal 2 is fixed to the housing 10. Further, when the terminal 2 is inserted into the terminal cavity 11, the rubber plug 50 is also inserted into the terminal cavity 11.

Next, the rear holder 30 is inserted into the terminal cavity 11 from the rear side of the housing 10. The holder locking arm 31 of the rear holder 30 is locked to the housing locking portion 15 of the housing 10. This operation fits the rear holder 30 to the housing 10 and prevents the rubber plug 50 from dropping off.

Then, the packing 51 is inserted from the front side of the housing 10, and then the front holder 20 is inserted from the front side of the housing 10. The holder locking portion 22 of the front holder 20 locks the housing locking arm 13 of the housing 10. This operation fits the front holder 20 to the housing 10 and prevents the packing 51 from dropping off.

Next, the shell 40 is inserted from the rear side of the housing 10. The shell locking hole 43 of the shell 40 locks the housing locking arm 14 of the housing 10. This operation fits the shell 40 to the housing 10.

Then, the end portion of the braided wire (not illustrated) covering the outer periphery of the electric wires W is disposed on the tubular portion 41 of the shell 40. The shield ring 45 is crimped from the upper portion of the braided wire (not illustrated), to thereby fix the shield ring 45. This fixes the braided wire (not illustrated) together with the shield ring 45 to the shell 40. This completes the assembly.

As explained above, the connector 1 includes the terminals 2 each having the terminal locking hole 3, the housing 10 having the terminal cavities 11 into which the terminals 2 are inserted, and the housing lances 12 each configured to be locked with the terminal locking hole 3 of concerned terminal 2, and the front holder 20 configured to be fitted to the housing 10 and having the holder elastic arms 23 fir biasing the terminals 2 in the direction to hook the terminals 2 to the housing lances 12. Thus, since the holder elastic arms 23 biase the terminals 2 in the direction of hooking the terminals 2 to the housing lances 12, the terminals 2 are unlikely to be shifted in the direction to drop off from the housing lances 12. Accordingly, each of the terminals 2 is locked in a root portion of each of the housing lances 12, that is, a portion having a large shear area. As a result, the locking force of the housing lance 12 can be prevented from being weak. Further, as explained in the above assembly procedure, the terminal 2 is inserted into the terminal cavity 11 of the housing 10, and then, the front holder 20 is fitted to the housing 10. With such a structure, when the terminal 2 is inserted into the terminal cavity 11, there is no possibility of damaging the holder elastic arm 23 by the insertion of the terminal 2. Thus, a desired terminal holding force that is continuously stable can be obtained, without any possibility of damaging the holder elastic arm 23 at the time of inserting the terminal 2.

Further, with the connector according to the other conventional example, when inserting the terminal 101, it is necessary to insert the terminal 101 against the biasing force of the housing elastic arm 113, causing a possibility that a high inserting force is required. However, with the connector 1 according the embodiment of the present invention, when inserting the terminal 2, no biasing three is exerted from the holder elastic arm 23. Thus, the terminal 2 can be inserted by a low insertion force, thus bringing about an advantage of improving the insertion workability.

The front holder 20 has the arm support portion 24 for supporting the holder elastic arm 23, the holder locking portion 22 is provided at the opposite side of the arm support portion 24, and the housing locking arm 13 of the housing 10 is locked with the holder locking portion 22. Therefore, the biasing force of the housing locking arm 13 of the housing 10 is caused to act on the arm support portion 24, and thus preventing such an event that the biasing force to the terminal 2 becomes lower due to the arm support portion 24 shifted by a reactive force from the holder elastic arm 23. Accordingly, the holder elastic arm 23 assuredly applies a stable desired biasing force to the terminal 2.

The terminal 2 has the bolt tightening hole 4. That is, a great external force may be applied to the terminal 2 at the time of tightening of the bolt. In this case, due to the gap of the terminal cavity 11, the terminal 2 is displaceable against the biasing force of the holder elastic arm 23. This can prevent, as much as possible, such an event that the external force at the time of tightening the bolt may deform or damage the terminal 2 or the housing 10.

When the front holder 20 is fitted to the housing 10, in a state where the housing lance 12 is not locked with the terminal locking hole 3, the protruding portion 25 of the front holder 20 interferes with the housing lance 12 to thereby prevent the front holder 20 from being fitted to the housing 10. Further, in the position where the front holder 20 is fitted to the housing 10, the protruding portion 25 of the front holder 20 prevents the elastic deformation in the direction in which the housing lance 12 drops off from the terminal locking hole 3. Thus, it is possible to prevent the front holder 20 from being fitted to the housing 10 while the housing lance 12 is not locked to the terminal 2. Further, after the front holder 20 is fitted to the housing 10, the housing lance 12 can be prevented from dropping off from the terminal locking hole 3.

INDUSTRIAL APPLICABILITY

The present invention is usable for a high-current and high-voltage connector installed to an automotive wire harness or the like.

The invention claimed is:

1. A connector, comprising:

a terminal having a terminal locking hole;

a housing comprising a terminal cavity into which the terminal is inserted, and a housing lance configured to be locked with the terminal locking hole of the terminal inserted into the terminal cavity; and a holder configured to be fitted to the housing and comprising a holder elastic arm for biasing the terminal in a direction of hooking the terminal to the housing lance, wherein the holder comprises an arm support portion for supporting the holder elastic arm, and a holder locking portion disposed at an opposite side of the arm support portion, wherein the housing has a housing locking arm, and wherein the housing locking arm is configured to be locked with the holder locking portion.

2. The connector according to claim 1, wherein the terminal has a bolt tightening hole.

* * * * *